US009415247B2

(12) United States Patent
Schurian et al.

(10) Patent No.: US 9,415,247 B2
(45) Date of Patent: Aug. 16, 2016

(54) QUICK RELEASE CONNECTOR FOR FALL PROTECTION

(71) Applicant: Alexander Andrew, Inc., Compton, CA (US)

(72) Inventors: Cortland G. Schurian, Long Beach, CA (US); Michael Dancyger, Los Angeles, CA (US)

(73) Assignee: Alexander Andrew, Inc., Compton, CA (US)

( * ) Notice: Subject to any disclaimer, the term of this patent is extended or adjusted under 35 U.S.C. 154(b) by 0 days.

(21) Appl. No.: 14/202,994

(22) Filed: Mar. 10, 2014

(65) Prior Publication Data

US 2014/0251725 A1 Sep. 11, 2014

Related U.S. Application Data

(60) Provisional application No. 61/775,612, filed on Mar. 10, 2013.

(51) Int. Cl.
*A62B 35/00* (2006.01)
*A44B 11/25* (2006.01)

(52) U.S. Cl.
CPC ..... *A62B 35/0025* (2013.01); *A44B 11/2519* (2013.01); *A44B 11/2569* (2013.01); *A62B 35/0037* (2013.01); *Y10T 24/45623* (2015.01)

(58) Field of Classification Search
CPC ..... Y10T 24/45581; Y10T 24/45602; Y10T 24/45634; Y10T 24/45623; Y10T 24/45628; A62B 35/0025; A62B 35/0037; A44B 11/253; A44B 11/2576; A44B 11/2511; A44B 11/2569; A44B 11/2519
See application file for complete search history.

(56) References Cited

U.S. PATENT DOCUMENTS

| | | | | | |
|---|---|---|---|---|---|
| 2,903,774 | A | * | 9/1959 | Bernard | 24/170 |
| 5,144,725 | A | * | 9/1992 | Krauss | 24/625 |
| 5,380,067 | A | * | 1/1995 | Turvill et al. | 297/484 |
| 5,383,257 | A | * | 1/1995 | Krauss | 24/625 |
| 5,548,879 | A | * | 8/1996 | Wu | 24/625 |
| D452,834 | S | * | 1/2002 | Ko | D11/216 |
| 2006/0048350 | A1 | * | 3/2006 | Coulombe et al. | 24/634 |
| 2008/0028579 | A1 | * | 2/2008 | Chen | 24/625 |
| 2010/0243373 | A1 | * | 9/2010 | Johnson et al. | 182/3 |
| 2011/0239413 | A1 | * | 10/2011 | Milbright | 24/191 |

* cited by examiner

*Primary Examiner* — Katherine Mitchell
*Assistant Examiner* — Shiref Mekhaeil

(57) ABSTRACT

A quick release buckle includes a main body portion including a top housing portion and a bottom housing portion. A t-bar element removably connects within the main body portion. A pair of locking pawls removably connect with an extension portion of the t-bar element. A locking wheel device is configured for locking and unlocking the pair of pawls based on contact of pawl extensions with one or more portions of the locking wheel device.

14 Claims, 10 Drawing Sheets

(REPLACEMENT SHEET)

QUICK RELEASE CONNECTOR FOR FALL PROTECTION

CROSS-REFERENCE TO RELATED APPLICATIONS

This application claims the priority benefit of U.S. Provisional Patent Application Ser. No. 61/775,612, filed Mar. 10, 2013, which is incorporated herein by reference in its entirety.

BACKGROUND

1. Field

The embodiments relate to fall protection devices, and in particular to quick release connectors.

2. Description of the Related Art

Workers that work in elevated environments may employ fall protection gear, such as a fall protection harness and lanyard with a buckle. The current buckles include manually released pawls (e.g., locking portions) that are susceptible to accidental release based on a workers movement and contact with the pawls with elements in the work environment (e.g., bumping into objects, leaning on objects, handling of other gear, etc.).

SUMMARY

One embodiment provides a quick release buckle includes a main body portion including a top housing portion and a bottom housing portion. A t-bar element removably connects within the main body portion. A pair of locking pawls removably connect with an extension portion of the t-bar element. A locking wheel device is configured for locking and unlocking the pair of pawls based on contact of pawl extensions with one or more portions of the locking wheel device.

Another embodiment provides a system including a fall protection safety harness. A quick release buckle is coupled with the fall protection safety harness. In one embodiment, the quick release buckle comprises: a main body portion including a top housing portion and a bottom housing portion; an insertion element that removably couples within the main body portion; a pair of pawls that removably couple with an extension portion of the insertion element; and a rotating device that is configured for locking and unlocking the pawls based on contact of a portion of the pawls with one or more portions of the rotating device.

One embodiment provides a quick release buckle comprising a main body portion. A buckle insertion element removably couples within the main body portion. In one embodiment, two or more locking pawls removably couple with an extension portion of the buckle insertion element. In one embodiment, a rotating device is configured for preventing the two or more pawls from movement internal to the main body portion based on contact of pawl extensions with one or more portions of the rotating device.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of fall protection quick release buckles (e.g., for safety harnesses) with locking pawls systems and devices, as well as operation and/or component parts thereof. While the following description will be described in terms of fall protection quick release buckles with locking pawls systems and devices for clarity and to place the invention in context, it should be kept in mind that the teachings herein may have broad application to all types of systems, devices and applications.

One embodiment of the invention provides a quick release buckle includes a main body portion including a top housing portion and a bottom housing portion. In one embodiment, a t-bar element removably connects within the main body portion. In one embodiment, a pair of locking pawls removably connect with an extension portion of the t-bar element. A locking wheel device is configured for locking and unlocking the pair of pawls based on contact of pawl extensions with one or more portions of the locking wheel device.

Figure 1:
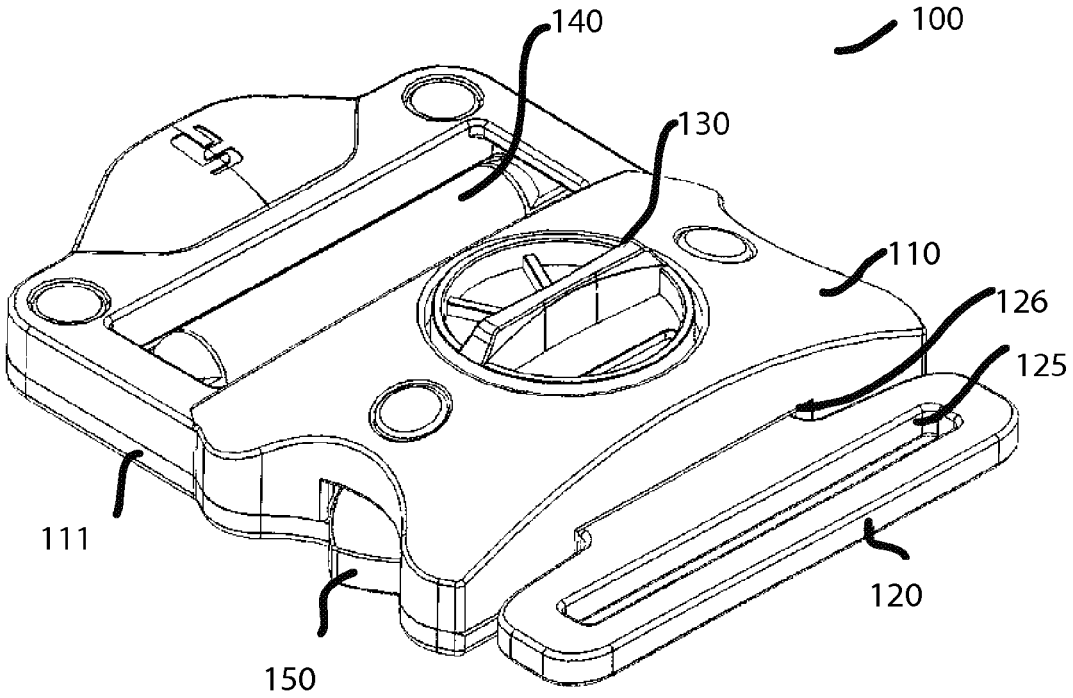
FIG. 1 illustrates a perspective view of a quick connect buckle with locking pawls, according to one embodiment.
Figure 2:
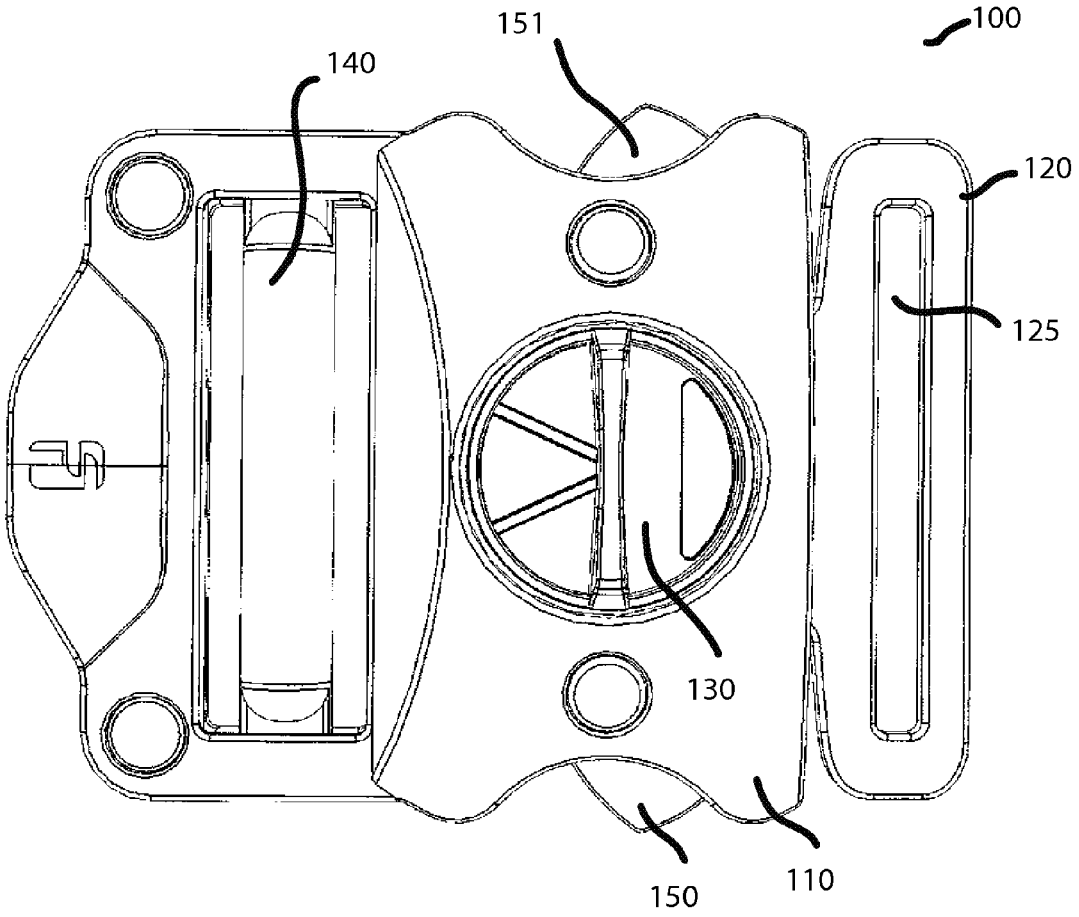
FIG. 2 illustrates a top view of a quick connect buckle with locking pawls, according to one embodiment.

FIG. 1 illustrates a perspective view of a quick connect buckle 100 with locking pawls 150/151, according to one embodiment. In one embodiment, the quick connect buckle 100 includes a top housing portion 110, a bottom housing portion 111, T-bar or insertion element (e.g., buckle insert) 120 with a belt/webbing opening 125, lock/release knob 130, belt/webbing adjusting/locking roller 140, and locking pawls 150 and 151 (FIG. 2). In one embodiment, the quick connect buckle 100 may be implemented with a safety harness (e.g., a web/webbing harness, safety vest, safety suit, etc.) for fall protection. In other embodiments, the quick release buckle 100 may be implemented in other safety uses, such as safety belts connected to safety lines, or any other product that may require additional safety features of locking pawls for a quick release buckle system. In one embodiment, the quick connect buckle 100 provides a heightened level of security with a pawl locking feature implemented by turning the lock/release knob 130.

In one embodiment, the top housing portion 110 may be made out of high strength, lightweight aluminum material. In other embodiments, the top housing portion may be made out of other strong materials, such as metals, metal alloys, etc. In one embodiment, the top housing portion 110 may comprise a molded component designed to house or encapsulate the lock/release knob 130, the knob wheel or rotating element 420 (FIG. 4) and the locking/release pawls 150 and 151 (FIG. 2).

In one embodiment, the male T-bar 120 may be made in high strength steel, metal alloy materials, or other similar strength material. In one embodiment, the T-bar 120 is may be inserted into the female opening 126 formed between the top housing portion 110 and the bottom housing portion 111 to automatically lock with the pawls 150 and 151 until a user manually releases the pawls 150 and 151 using the lock/release knob 130 allowing the male T-bar 120 to be removed from the female opening 126 for the quick release buckle 100 to be disengaged.

In one embodiment, the pawls 150 and 151 (FIG. 2) may be made of brass, steel, aluminum or similar strength materials. In one embodiment, the pawls 150 and 151 are attached firmly between the top housing portion 110 and the bottom housing portion 111 allowing a portion of the pawls 150 and 151 to protrude out of the housings to act as manual release levers when the lock/release knob 130 is not in a locking position. In one embodiment, the internal portion of the pawls 150 and 151 serve as spring 910 (FIG. 9) operated, and an auto locking mechanism on the quick connect buckle 100.

In one embodiment, the lock/release knob 130 engages the knob wheel 420 (FIG. 4) that is housed between the top housing portion 110 and the bottom housing portion 111. In one embodiment, the knob wheel 420 may be made out of a high strength composite material. In one embodiment, the knob wheel 420 is attached to the lock/release knob 130 that is accessible from the outer surface of the top housing portion 130 and serves as the pawl 150 and 151 locking mechanism that prevents the pawls 150 and 151 from being manually depressed toward the housing formed from the top housing portion 110 and the bottom housing portion 111. In one embodiment, the lock/release knob 130 may be made of a high strength composite material. In one embodiment, the lock/release knob 130 allows a user to lock or unlock the pawls with a simple 180 degree turn (either clockwise or counter-clockwise) In one embodiment, turning the lock/release knob 130 may unlock the pawls 150 and 151 allowing users to manually depress the pawls 150 and 151 for releasing the T-bar 120. In one embodiment, turning the lock/release knob 130 back 180 degrees provides for locking the pawls 150 and 151 by preventing the inner portion of the pawls 150 and 151 from moving inwards and preventing the T-bar 120 from being released (intentionally or unintentionally). In one embodiment, as a further safety advantage the lock/release knob 130 has a window or opening 710 (FIG. 7) allowing the indicator 438 (FIG. 4) to be viewed (e.g., a red indication for indicating an unlocked state and a green indication for indicating a locked state, markings, etc.).

In one embodiment, the body of the quick release buckle 100 may be made of a molded and tooled top housing portion 110 made of aluminum, while the bottom housing portion 111 may be made of a solid layer of steel riveted to the top housing portion 110. In one embodiment, as assembled, the female formed housing (between the top housing portion 110 and the bottom housing portion 111) is designed to connect with harness webbing and the male T-bar 120 end. Inside the female formed housing the pawls 150 and 151 (FIG. 2) are positioned and fixed with fasteners, such as rivets, so they protrude out of the female housing and inside the female housing. In one embodiment, the pawl portion inside the housing connects with the male T-bar extension portion 430 (FIG. 4) allowing the quick connect buckle 100 to be "connected."

Figure 3:
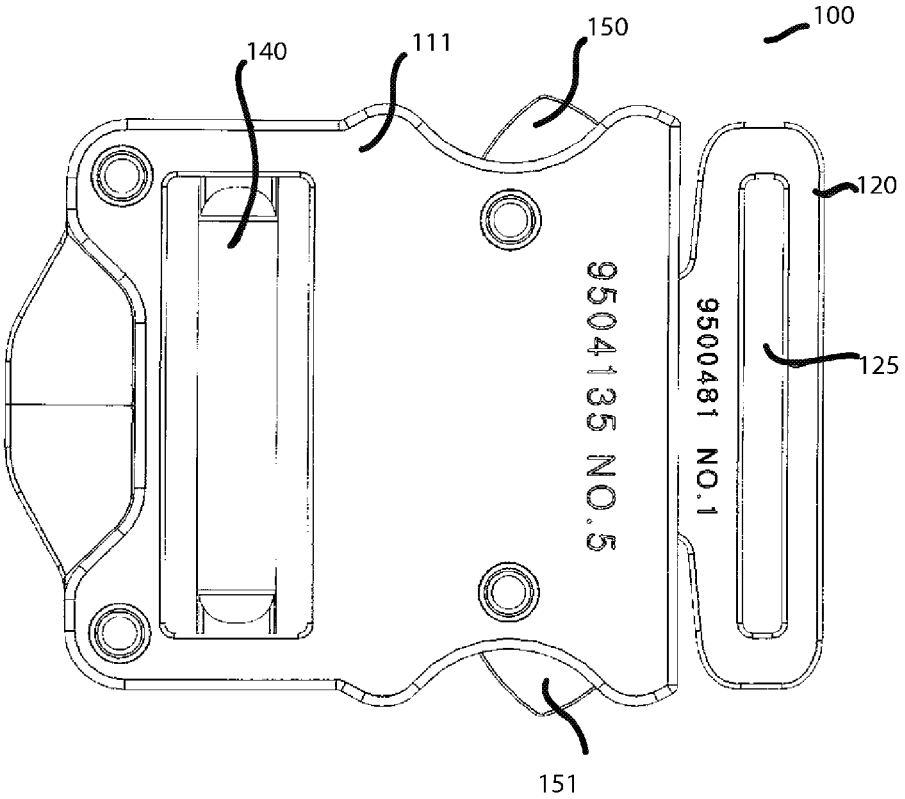
FIG. 3 illustrates a bottom view of a quick connect buckle with locking pawls, according to one embodiment.

FIG. 2 illustrates a top view of the quick connect buckle 100 with locking pawls 150 and 151, according to one embodiment. In one example embodiment, as shown the T-bar 120 is inserted into the female formed housing between the top housing portion 110 and the bottom housing portion 111. FIG. 3 illustrates a bottom view of a quick connect buckle 100 with locking pawls 150 and 151, according to one embodiment.

Figure 4:
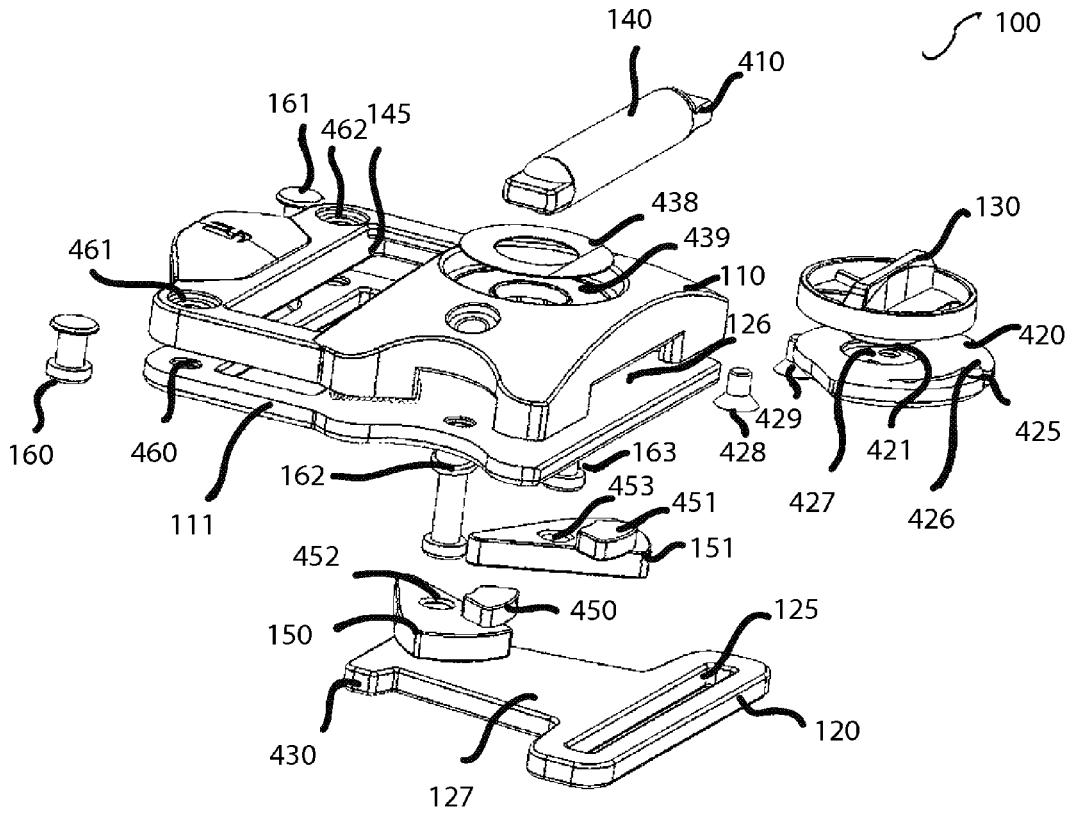
FIG. 4 illustrates an exploded view of a quick connect buckle with locking pawls, according to one embodiment.

FIG. 4 illustrates an exploded view of a quick connect buckle 100 with locking pawls 150 and 151, according to one embodiment. In one embodiment, the quick connect buckle 100 includes fasteners (e.g., rivets) 160 and 161 that attach the top housing portion 110 with the bottom housing portion through the openings 460 and 461, respectively. In one embodiment, a fastener 162 may be placed though the opening 452 and through openings in the top housing portion 110 and bottom housing portion 111 for rotational movement of the pawl 150 (and similar components/opening for pawl 151 and its opening 453).

In one embodiment, fasteners 428 and 429 attach the knob wheel 420 to the lock/release knob 130 through holes 601 and 602 (FIG. 6) in the fitment portion 427. In one embodiment, the belt/webbing adjusting/locking roller 140 includes ends 410 that allow the belt/webbing adjusting/locking roller 149 to slide or lock within the space 145 between the top housing portion 110 and the bottom housing portion 111.

In one embodiment, the indicator 438 includes a red portion and a green portion (and or indicator words or markings, such as locked, safe, etc., and unlocked, open, unsafe, etc.) on its top portion that are visible through the window 710 (FIG. 7) in the lock/release knob 130. In one embodiment, the indicator 438 may be placed on the knob holder 439. In one embodiment, the indicator 438 may be a sticker or other material that is permanently fixed to the knob holder 439. In other embodiments, the indicator 438 is not used, but instead permanent indicators are painted or adhered to the knob holder 439.

In one embodiment, the opening 425 and slot/groove 426 make up a "snap to lock" system, which allows the user to feel and hear when the lock/release knob 130 has been placed in the fully locked position or into the fully unlocked position. In one embodiment, the nub or protrusion 426 is placed on sculpted out swing arm of off the main pawls 150 and 151 locking structure. In one embodiment, the arm 425 allows the nub 426 to swing slightly ensuring it finds its preset indicator cavities built into the top housing portion 110. In one embodiment, when the nub 426 reaches the cavities in the top housing portion 110, the nub 426 snaps into the cavity indicating to the user they have turned the lock/release knob 130 to its desired end location, either locked or unlocked.

In one embodiment, the pawl extensions 451 and 452 operates as flanges or locking locations for portions of the knob wheel 420, which are secondary locking wheel mechanisms (i.e., in addition to the locking action of the T-bar extension portion 430 on the pawls 150 and 151). In one example embodiment, when the lock/release knob 130 is turned, the knob wheel 420 turns to prevent the pawls and pawl extensions 151/451 and 150/450 from moving. In one embodiment, the knob wheel 420 is shaped such that when the knob wheel 420 is turned from the locked position by 180 degrees, the pawls 150 and 151 may be freely moved to disengage the T-bar 120 from the female opening 126.

Figure 5:
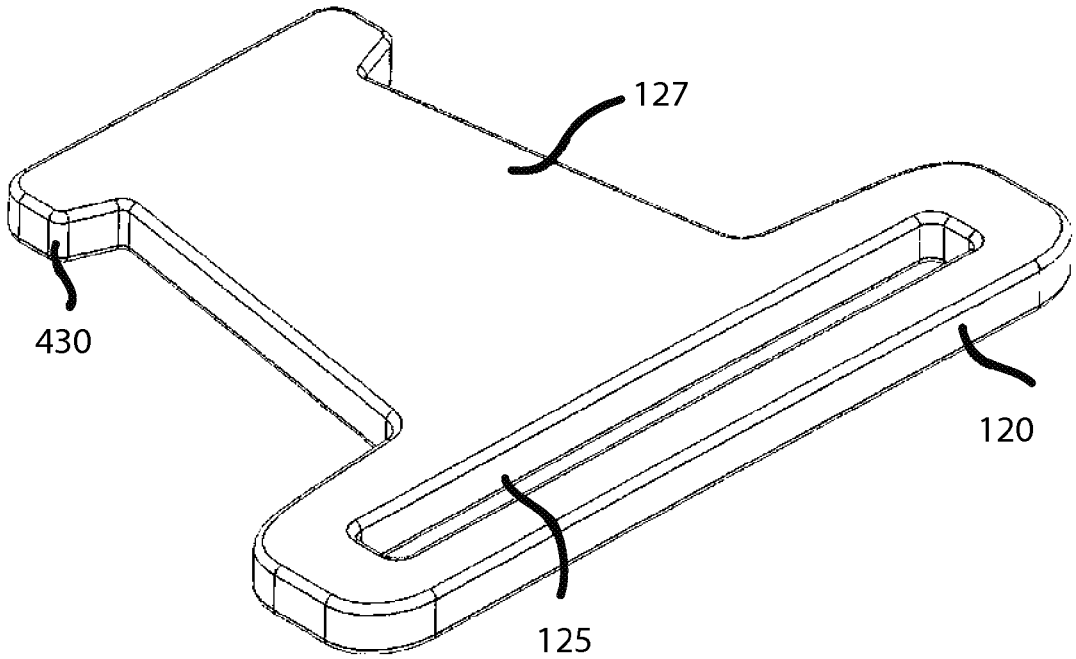
FIG. 5 illustrates an isolated view of a male T-bar for a quick connect buckle with locking pawls, according to one embodiment.
Figure 6:
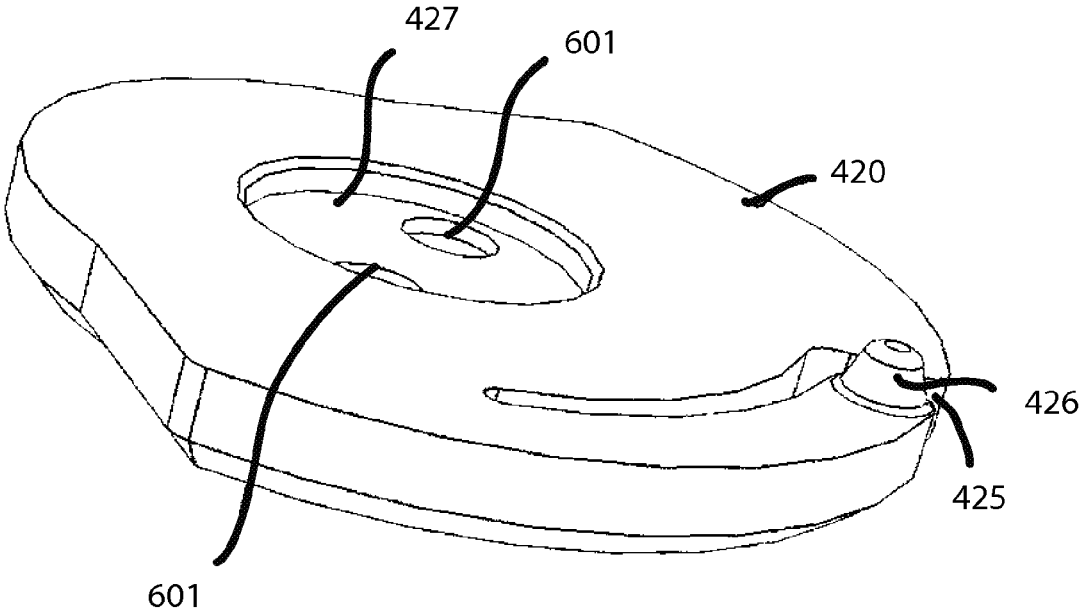
FIG. 6 illustrates an isolated view of a knob wheel for a quick connect buckle with locking pawls, according to one embodiment.

FIG. 5 illustrates an isolated view of a male T-bar 120 for a quick connect buckle 100 with locking pawls 150 and 151, according to one embodiment. In one embodiment, the extensions 430 push past the pawls 150 and 152 that have tension due to springs 910 (FIG. 9) pressing on them, and lock in place against the pawl ends 911 (FIG. 9) (unless the pawls 150 and 151 are pressed manually inward when the lock/release knob 130 is in the un-locked position/state. FIG. 6 illustrates an isolated view of the knob wheel 420 for a quick connect buckle 100 with locking pawls 150 and 151, according to one embodiment.

Figure 7:
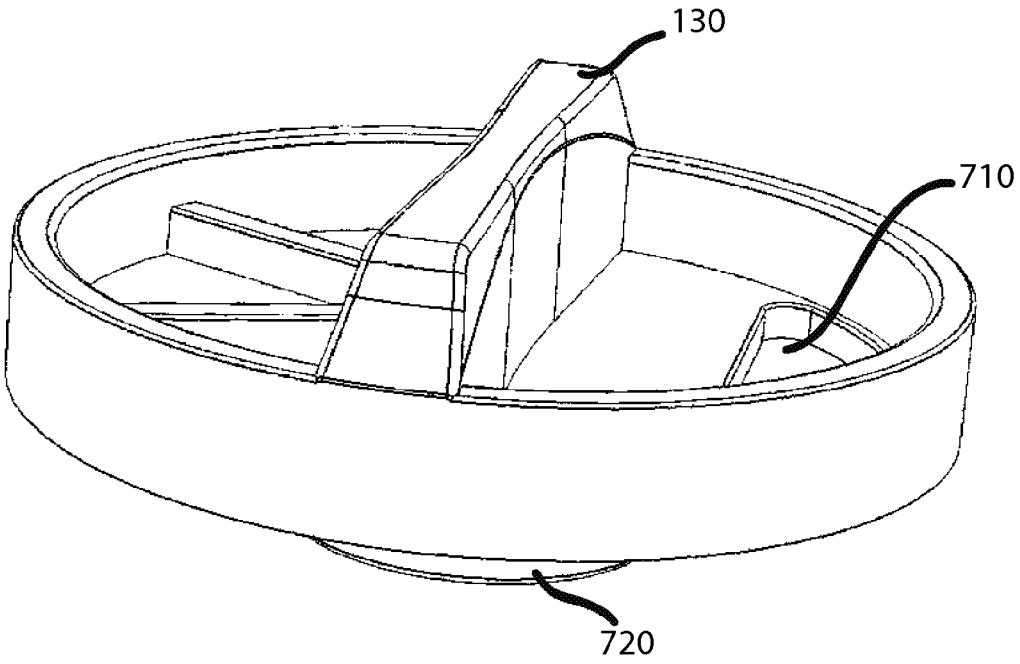
FIG. 7 an isolated view of lock/release knob for a quick connect buckle with locking pawls, according to one embodiment.

FIG. 7 an isolated view of lock/release knob 130 for a quick connect buckle 100 with locking pawls 150 and 151, according to one embodiment. In one embodiment, the window 710 provides for view indicators, such as indicators on the indicator 438 (e.g., red/green indicators indicating locked/unlocked).

Figure 8:
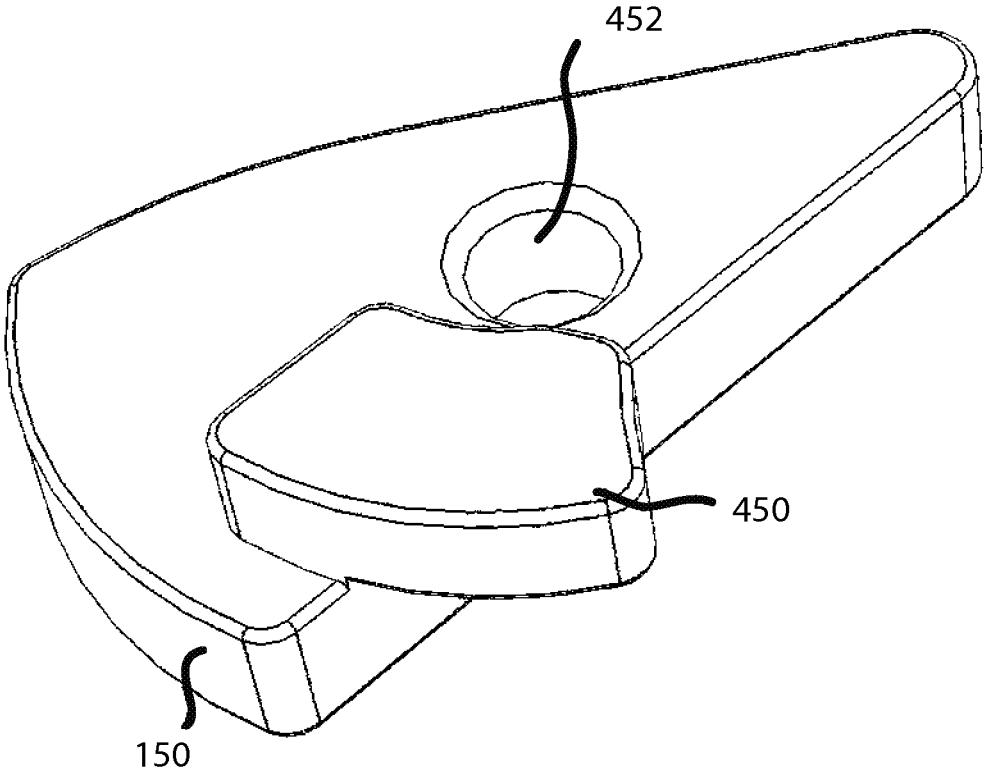
FIG. 8 illustrates an isolated view of locking pawl for a quick connect buckle, according to one embodiment.

FIG. 8 illustrates an isolated view of locking pawl 150 for a quick connect buckle 100, according to one embodiment. In one embodiment, the pawl extension 450 provides for locking the pawl 150 against the knob wheel 420 when the lock/release knob 130 is in the locked position/state.

Figure 9:
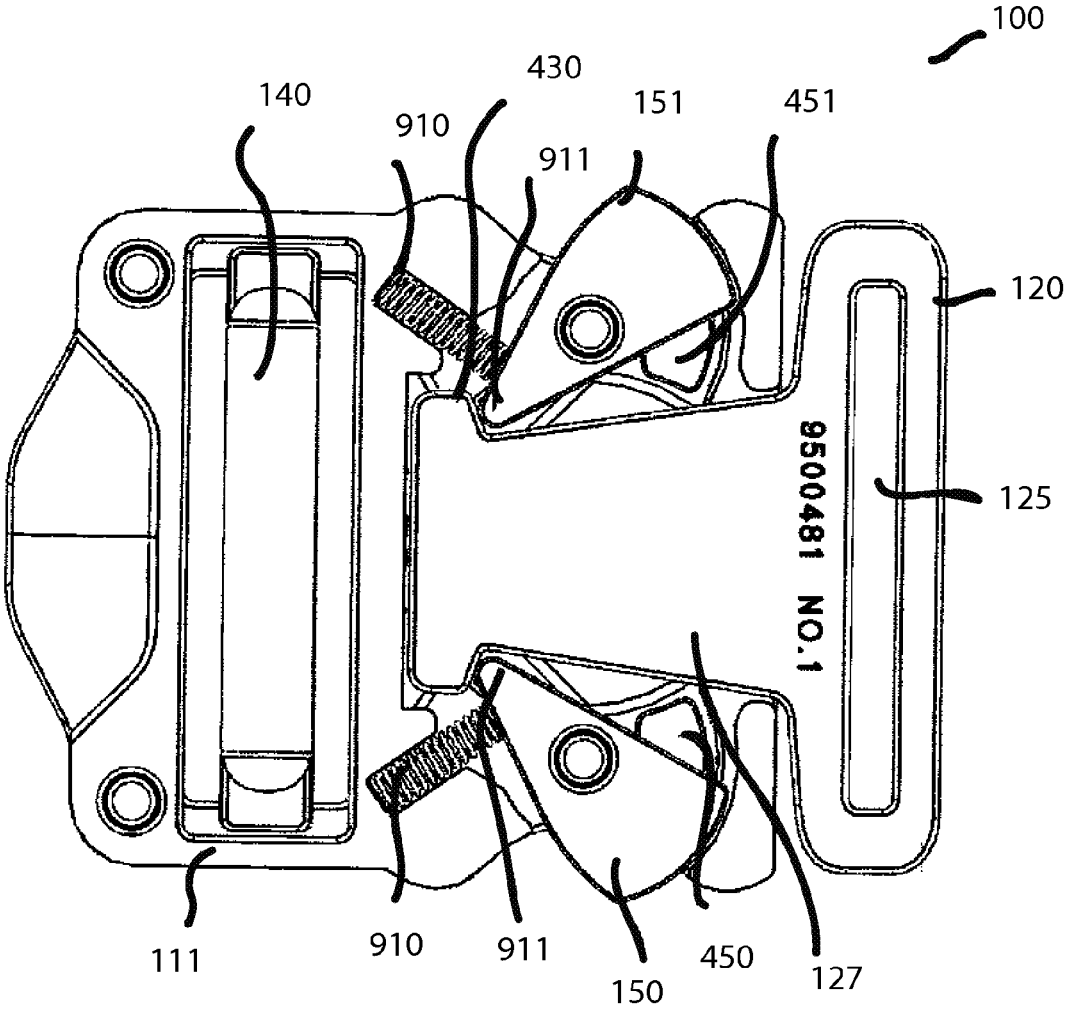
FIG. 9 illustrates a bottom internal view of a quick connect buckle with locking pawls, according to one embodiment.

FIG. 9 illustrates a bottom internal view of a quick connect buckle 100 with locking pawls 150 and 151, according to one embodiment. In one example embodiment, springs 910 are engaged in placement holders or slots and compress/expand to maintain a force on the pawl ends 911. In one embodiment, the T-bar 120 is inserted into the female opening 126 and contact the pawl ends 9111 and force the pawls 150 and 151 to rotate and force the springs to compress, which allows the T-bar extensions 420 to force past the pawl ends 911 until the pawls 150 and 151 rotate back based on the spring action from the springs 910. The T-bar ends 430 are then prohibited from being removed from the contact with the pawl ends 911 unless the pawls 150 and 151 are pressed inwards to rotate the pawl ends outwards away from the T-bar extensions 430.

Figure 10:
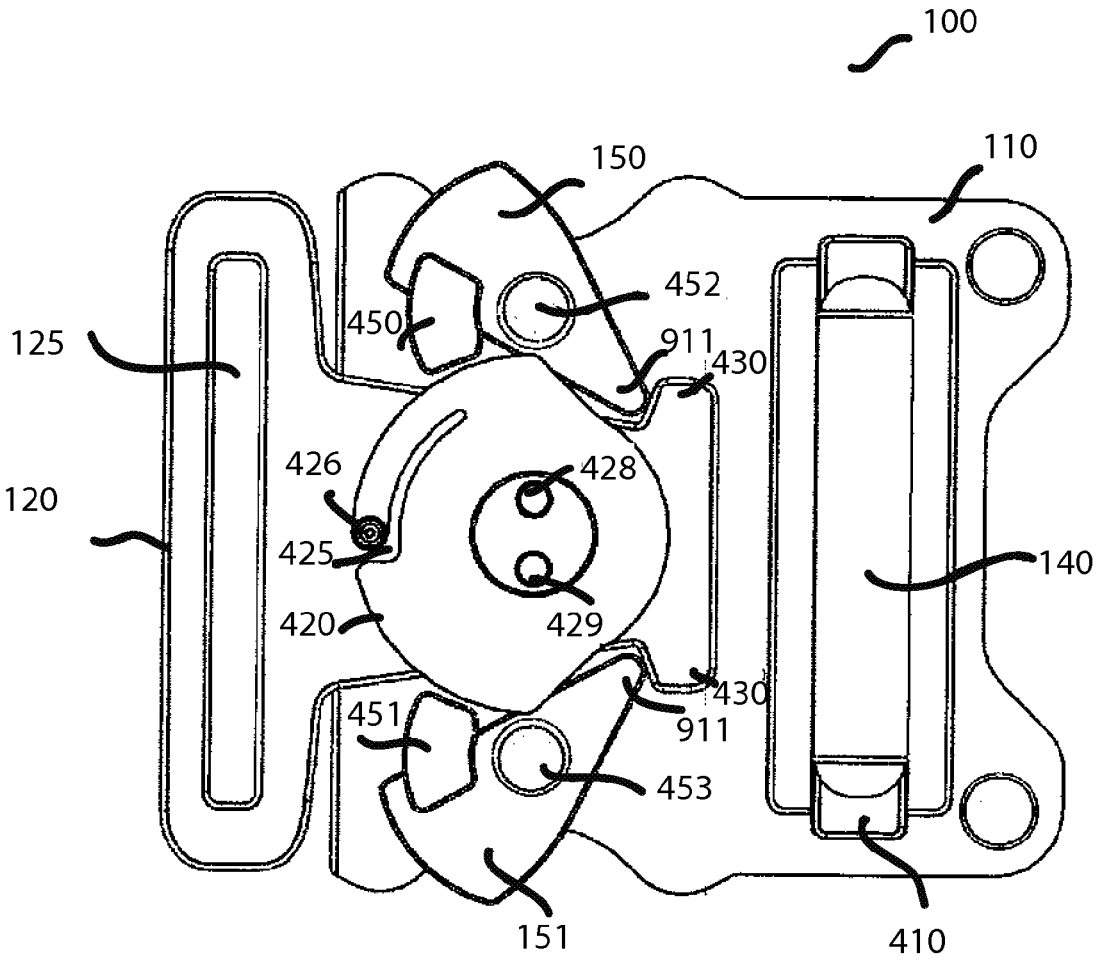
FIG. 10 illustrates a top internal view of a quick connect buckle with locking pawls, according to one embodiment.

FIG. 10 illustrates a top internal view of a quick connect buckle 100 with locking pawls 150 and 151, according to one embodiment. In one example embodiment, the knob wheel 420 is shown in a locked state/position where the pawl extensions 450 and 451 are locked by the portion of the knob wheel 420 preventing the pawls 150 and 151 from being depressed (either intentionally or unintentionally). In one embodiment, the pawl extensions 451 and 450 contact the knob wheel 420 in the locked state/position and prevent the pawls 150 and 152 from being pressed inwards from outside of the quick release buckle 100. It should be noted that in the unlocked state or position of the knob wheel 420, the pawls 150 and 151 may be pressed inwards and the pawls ends 911 are allowed to move towards the knob wheel 420 based on the shape of the wheel, which allows the pawl extensions to move inward when the pawls 150 and 151 are pressed in.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A quick release buckle comprising:

a main body portion including a top housing portion and a bottom housing portion;

a t-bar element that removably couples within the main body portion, a first locking pawl configured to removably couple with a first portion of an extension portion of the t-bar element, the first locking pawl having a top portion and a bottom portion, and the first locking pawl includes a first pawl extension coupled to the lop portion of the first locking pawl;

a second locking pawl configured to removably couple with a second portion of the extension portion of the t-bar element, the second locking pawl having a top portion and a bottom portion, and the second locking pawl includes a second pawl extension coupled to the top portion of the second locking pawl; and a locking wheel device that is configured for locking and unlocking the first locking pawl and the second locking pawl based on contact of the first pawl extension with a first portion of the locking wheel device and contact of the second pawl extension with a second portion of the locking wheel device, the first portion and the second portion of the locking wheel have curved sections configured to contact the first and second pawl extensions respectively and the locking wheel further having a first flat portion and a second flat portion, wherein the first locking pawl and the second locking pawl form a primary lock against the t-bar element, and the first pawl extension and the second pawl extension form a secondary lock against the locking wheel device.

2. The quick release buckle of claim 1, further comprising:

a knob device coupled with the locking wheel device, wherein the knob device rotates to a locked position and an unlocked position for preventing intentional and unintentional movement of the first locking pawl and the second locking pawl, the first pawl extension extends over an outer edge of the top portion of the first locking pawl, and the second pawl extension extends over an outer edge of the top portion of the second locking pawl.

3. The quick release buckle of clam 2, further comprising a circular indicator element that is configured to indicate the locked position and the unlocked position through a window of the knob device based on position of the knob device.

4. The quick release buckle of claim 3, wherein the circular indicator element includes a green portion that indicates the locked position and a red portion that indicates the unlocked position.

5. The quick release buckle of claim 4, wherein the locking wheel device includes a nub portion and a slot portion that are used for indicating the locked position and the unlocked position.

6. The quick release buckle of claim 1, wherein the t-bar element includes a first webbing coupling portions of a fall protection safety harness.

7. The quick release buckle of claim 6, further comprising a rolling element configured for coupling with a second webbing portion of the fall protection safety harness.

8. A quick release buckle comprising:

a main body portion;

a buckle insertion clement that removably couples within the main body portion;

a first locking pawl that removably couples with a first extension portion of the buckle insertion clement, the first locking pawl having a top portion and a bottom portion, and the first locking pawl includes a first pawl extension coupled to the top portion of the first locking pawl;

a second locking pawl that removably couples with a second extension portion of the buckle insertion element, the second locking pawl having a top portion and a bottom portion, and the second locking pawl includes a second pawl extension coupled to the top portion of the second locking pawl; and a rotating device that is configured to prevent the first locking pawl and the second locking pawl from movement internal to the main body portion based on contact of the first pawl extension with a first portion of the rotating device and contact of the second pawl extension with a second portion of the rotating device, the first portion and the second portion of the rotating device have curved sections configured to contact the first and second pawl extension respectively, and the rotating device further having a first flat portion and a second flat portion, wherein the first locking pawl and the second locking pawl form a primary lock against the buckle insertion element, and the first pawl extension and the second pawl extension form a secondary lock against the rotating device.

9. The quick release buckle of claim 8, further comprising:

a knob device coupled with the rotating device, wherein the knob device rotates to a locked position and an unlocked position for preventing intentional and unintentional movement of the first locking pawl and the second locking pawl; and an indicator element that is configured to indicate the locked position and the unlocked position through a window of the knob device based on position of the knob device.

10. The quick release buckle of claim 9, wherein the indicator element includes markings for indicating the locked position and the unlocked position.

11. The quick release buckle of claim 10, wherein the rotating device includes a nub portion and a slot portion that are used for indicating the locked position and the unlocked position.

12. The quick release buckle of claim 8, wherein the buckle insertion element includes a first webbing coupling portion of a fall protection safety harness.

13. The quick release buckle of claim 12, further comprising a rolling element configured for coupling with a second webbing portion of the fall protection safety harness.

14. The quick release buckle of claim 8, wherein, the first pawl extension extends over an outer edge of the top portion of the first locking pawl, and the second pawl extension extends over an outer edge of the top portion of the second locking pawl.

* * * * *